US008870093B2

(12) United States Patent
Brummitt

(10) Patent No.: US 8,870,093 B2
(45) Date of Patent: Oct. 28, 2014

(54) DISPENSER

(75) Inventor: Richard Brummitt, Basingstoke (GB)

(73) Assignee: P.C. Cox Limited, Berkshire (GB)

( * ) Notice: Subject to any disclaimer, the term of this patent is extended or adjusted under 35 U.S.C. 154(b) by 426 days.

(21) Appl. No.: 13/336,462

(22) Filed: Dec. 23, 2011

(65) Prior Publication Data

US 2012/0160936 A1 Jun. 28, 2012

(30) Foreign Application Priority Data

Dec. 23, 2010 (EP) ..... 10196816

(51) Int. Cl.

| | |
|---|---|
| ***B05B 11/02*** | (2006.01) |
| ***B05B 7/12*** | (2006.01) |
| ***B05B 7/06*** | (2006.01) |
| ***B05B 7/02*** | (2006.01) |
| ***B65D 35/30*** | (2006.01) |
| ***B65D 35/36*** | (2006.01) |
| ***B05B 7/04*** | (2006.01) |
| ***B05B 7/24*** | (2006.01) |
| ***B05C 17/005*** | (2006.01) |
| ***B05C 17/015*** | (2006.01) |

(52) U.S. Cl.

CPC ..... *B05C 17/00503* (2013.01); *B05B 7/0475* (2013.01); *B05B 7/2437* (2013.01); *B05C 17/015* (2013.01); *B05B 7/045* (2013.01)

USPC ..... 239/322; 239/369; 239/416.5; 239/417.5; 239/423; 239/424; 239/434.5; 239/526; 239/581.2; 239/583; 222/95; 222/105; 222/326; 222/327; 222/389

(58) Field of Classification Search

USPC ..... 239/290, 320–324, 369, 398, 407, 239/416.5, 417.5, 418, 423, 424, 434.5, 239/526, 581.1, 581.2, 583; 222/95, 105, 222/325–327, 389

See application file for complete search history.

(56) References Cited

U.S. PATENT DOCUMENTS

| | | | |
|---|---|---|---|
| 2,388,662 | A | 11/1945 | Anderson et al. |
| 2,582,156 | A | 1/1952 | Peterson |

(Continued)

FOREIGN PATENT DOCUMENTS

| | | |
|---|---|---|
| CH | 329614 | 4/1958 |
| DE | 1784336 | 8/1971 |

(Continued)

OTHER PUBLICATIONS

Korean Office Action from Korean Application No. 10-2011-0140003 dated Jun. 30, 2013. English translation provided.

(Continued)

*Primary Examiner* — Darren W Gorman

(74) *Attorney, Agent, or Firm* — Patterson Thuente Pedersen, P.A.

(57) ABSTRACT

A pneumatic dispenser for dispensing viscous material, for example, mastic caulk, from a container is described. The dispenser comprises a fluid supply arrangement for accepting a dispensing nozzle of the container and providing a flow of pressurized fluid to the dispensing nozzle to enable the material to be dispensed as a spray. A moveable member can be used to control the flow of pressurized fluid, for example a member disposed on a cap for closing a container containing compartment of the dispenser and/or a moveable member disposed around the dispensing nozzle. The arrangement of the fluid supply arrangement allows for convenient control of the pressurized fluid flow for spraying the material. Also disclosed is a dispenser with a readily exchangeable pressure application interface for applying a dispensing pressure to the container, enabling the dispenser to be used with both cartridge and foil pack containers.

11 Claims, 4 Drawing Sheets

(56) References Cited

U.S. PATENT DOCUMENTS

| | | | |
|---|---|---|---|
| 2,692,706 | A | 10/1954 | Carl |
| 2,705,463 | A | 4/1955 | Moore |
| 2,839,945 | A | 6/1958 | Zion |
| 2,840,276 | A | 6/1958 | Dreyer, Jr. et al. |
| 3,254,806 | A | 6/1966 | Niels |
| 3,353,537 | A | 11/1967 | Knox et al. |
| 3,431,953 | A | 3/1969 | Rutherford |
| 3,559,687 | A | 2/1971 | Aslan |
| 3,740,612 | A | 6/1973 | Gauthier et al. |
| 3,768,472 | A | 10/1973 | Hodosh et al. |
| 3,780,384 | A | 12/1973 | Rivelle |
| 3,819,115 | A | 6/1974 | Soderman |
| 3,980,209 | A | 9/1976 | Collar |
| 4,029,236 | A | 6/1977 | Carson, Jr. et al. |
| 4,116,364 | A | 9/1978 | Culbertson et al. |
| 4,171,072 | A | 10/1979 | Davis, Jr. |
| 4,174,068 | A | 11/1979 | Rudolph |
| 4,264,021 | A | 4/1981 | Davis, Jr. |
| 4,273,269 | A | 6/1981 | Davis, Jr. |
| 4,290,091 | A | 9/1981 | Malcolm |
| 4,322,022 | A | 3/1982 | Bergman |
| 4,366,919 | A | 1/1983 | Anderson |
| 4,376,498 | A | 3/1983 | Davis, Jr. |
| 4,472,141 | A | 9/1984 | Dragan et al. |
| 4,757,628 | A | 7/1988 | Bulfer |
| 5,125,836 | A | 6/1992 | Dragan et al. |
| 5,127,552 | A | 7/1992 | Bauman et al. |
| D329,277 | S | 9/1992 | Keske et al. |
| 5,163,584 | A | 11/1992 | Huber et al. |
| 5,219,097 | A | 6/1993 | Huber et al. |
| 5,277,099 | A | 1/1994 | Powers |
| 5,301,842 | A | 4/1994 | Ritter |
| 5,370,282 | A | 12/1994 | Sedlmeier |
| 5,489,207 | A | 2/1996 | Dragan et al. |
| 5,558,277 | A | 9/1996 | Owen et al. |
| D394,994 | S | 6/1998 | Dreve |
| 5,860,739 | A | 1/1999 | Cannon et al. |
| D411,421 | S | 6/1999 | Mayeur |
| 6,116,902 | A | 9/2000 | Schoedel et al. |
| 6,135,328 | A | 10/2000 | Schneider et al. |
| 6,401,988 | B1 | 6/2002 | Parent et al. |
| 6,412,667 | B1 | 7/2002 | Huang |
| 6,454,138 | B1 | 9/2002 | Greenhill et al. |
| D479,305 | S | 9/2003 | Zittel et al. |
| 6,681,957 | B1 | 1/2004 | Green |
| 6,929,157 | B2 | 8/2005 | Orecchia et al. |
| 7,334,709 | B1 | 2/2008 | Huang |
| D583,639 | S | 12/2008 | Axinte et al. |
| D588,231 | S | 3/2009 | Pellin et al. |
| 7,632,251 | B2 | 12/2009 | Lin et al. |
| D608,858 | S | 1/2010 | Baltz et al. |
| D649,221 | S | 11/2011 | Sinders et al. |
| D660,105 | S | 5/2012 | Brummitt |
| D660,663 | S | 5/2012 | Brummitt |
| 2002/0092871 | A1 | 7/2002 | Rickard |
| 2004/0126733 | A1 | 7/2004 | Ronvig |
| 2004/0216591 | A1 | 11/2004 | Assadi et al. |
| 2007/0102457 | A1 | 5/2007 | Campbell et al. |
| 2008/0149216 | A1 | 6/2008 | Speck |
| 2011/0095054 | A1 | 4/2011 | Hughes |
| 2012/0160877 | A1 | 6/2012 | Brummitt |

FOREIGN PATENT DOCUMENTS

| | | |
|---|---|---|
| DE | 3031939 | 8/1980 |
| DE | 3420324 | 12/1985 |
| DE | 9000957 | 4/1990 |
| DE | 9011965 | 10/1990 |
| DE | 102005038621 | 3/2007 |
| EP | 0276665 | 8/1988 |
| EP | 0406113 | 6/1990 |
| EP | 0443611 | 2/1991 |
| EP | 0436155 | 7/1991 |
| EP | 0448375 | 9/1991 |
| EP | 0525562 | 7/1992 |
| EP | 0551998 | 1/1993 |
| FR | 984352 | 7/1951 |
| GB | 793277 | 4/1958 |
| GB | 1589381 | 7/1977 |
| GB | 1555455 | 11/1979 |
| GB | 2276365 | 9/1994 |
| JP | H10156253 | 6/1998 |
| NL | 6602366 | 8/1966 |
| WO | WO2005/095225 | 10/2005 |
| WO | WO2006/106215 | 10/2006 |
| WO | WO2011/052891 | 5/2011 |

OTHER PUBLICATIONS

Japanese Office Action from Japanese Application No. 2011-283327, drafting date Jun. 25, 2013. English Translation provided.

Web page printout, "Complet Applicator Super Strong Single-dose applicator", Dec. 20, 2010. http://www.sdi.com.au/en.complet-applicator/.

Web page printout, "Complet Applicator (SDI) Interguide Dental and Medical Supply", Dec. 20, 2010. http://interguidedental.com/Complet-Applicator-SDI-p13579.html.

European Search Report for European Application No. EP91102643 dated Oct. 3, 1991.

European Search Report for European Application No. EP90401861 dated Mar. 13, 1991.

European Extended Search Report for European Application No. 10196812.1 dated Jul. 11, 2011.

European Extended Search Report of European Application No. 10196810.5 dated Jul. 19, 2011.

European Extended Search Report of European Application No. 10196813.9 dated Jun. 28, 2011.

European Extended Search Report of European Application No. 10196816.2 dated Jun. 22, 2011.

International Search Report of International Application No. PCT/FR2006/000710 dated Jul. 13, 2006.

Application and File History of Design U.S. Appl. No. 29/394,883, filed Jun. 22, 2011, inventor Brummitt.

Application and File History of Design U.S. Appl. No. 29/394,887, filed Jun. 22, 2011, inventor Brummitt.

Application and File History of Design U.S. Appl. No. 29/394,891, filed Jun. 22, 2011, inventor Brummitt.

Application and File History for U.S. Appl. No. 13/336,480, filed Dec. 23, 2011, inventor Brummitt.

Application and File History for U.S. Appl. No. 13/336,517, filed Dec. 23, 2011, inventor Brummitt.

European Search Report for European Application No. 10196812.1 dated Mar. 9, 2012.

Web page printout, "Universal Coaxial Adhesive Dispenser", printed Jun. 24, 2009 http:// www.5mix.com/Universal%20Dispenser.htm.

Cox Sealant Applicators, Jun. 17, 2008. http://www.toolbarn.com/product/CCM-380-10/.

GB Search Report from GB Application No. GB0918585.1 dated May 11, 2010.

Application and File History for U.S. Appl. No. 12/978,695, filed Dec. 27, 2010, inventor Burmmitt.

Application and File History for U.S. Appl. No. 12/910,462, filed Oct. 22, 2010, inventor Hughes.

DISPENSER

RELATED APPLICATION

The present application claims priority to EP Application No. 10196816.2 filed Dec. 23, 2010, which is incorporated by reference herein in its entirety.

FIELD OF THE INVENTION

The present invention relates to a pneumatic dispenser for viscous materials, in particular to such a dispenser capable of dispensing both a bead or a spray of the viscous material.

SUMMARY OF THE INVENTION

Pneumatic dispensers for viscous materials provided in containers such as cartridges or foil ("sausage") packs, or provided in bulk, are well known in the art. Typical examples of viscous materials dispensed with such cartridges are mastic caulking materials and other kinds of sealants. The cartridges typically comprise a dispensing end provided with a dispensing nozzle or a connector for connecting a dispensing nozzle and an opposed open rear end. The material inside the cartridge is sealed from the open rear end by a piston moveable within the cartridge. Known pneumatic dispensers for such cartridges comprise a body portion and a stock portion or handle for allowing a user to hold the dispenser. Typically, the stock portion comprises a connector for connecting the dispenser to a source of pressurized fluid, typically compressed air, and a valve actuatable by a trigger to apply a dispensing pressure. In use, the open end of the cartridge is held against a chamfered sealing ring or plug in the body portion to form a seal between a circuit for pressurized fluid and the cartridge such that the dispensing pressure drives the piston inside the cartridge forward, thereby dispensing the viscous material from the cartridge. An example of such a dispenser is disclosed in GB1589381.

In certain applications, for example, under-body sealing in car manufacture and maintenance, it is desirable to be able to lay down a bead of viscous material with the dispenser and, with the same dispenser, to spray the viscous material in a more dispersed pattern. Known dispensers for such applications include a spray nozzle provided around the dispensing nozzle of the cartridge and a pressurized fluid circuit for supplying pressurized fluid to the spray nozzle so that it flows along the dispensing nozzle and past a dispensing end of the nozzle, thereby atomizing viscous material dispensed from the dispensing nozzle into a spray.

In one known dispenser of this kind, the body portion comprises a cylinder attached to the stock portion. At the rear end of the cylinder an arrangement for supplying pressurized fluid behind a rear end of the viscous material container is provided and a cap is connectable to the front end of the cylinder to maintain the container within it. In one variant, the dispenser can be arranged for dispensing viscous materials from a foil pack, in which case a floating piston is provided inside the cylinder to transmit a dispensing pressure building up behind the floating piston as a trigger is actuated to the foil pack. In another variant, the rear portion of the dispenser comprises a sealing member for sealing against an open end of a cartridge as in GB1589381. The cap comprises a thread for accepting a spray nozzle around the dispensing nozzle and a conduit for pressurized fluid is connected between the cap and a rear portion of the cylinder, which is under pressure when material is dispensed. The conduit comprises a ball valve secured to the cylinder on one side and connected to the cap and rear end by respective hoses, allowing the flow of pressurized fluid around the dispensing nozzle through the spray nozzle to be switched on or off (or regulated at intermediate positions). When the valve is open during dispensing, pressurized fluid flows along the dispensing nozzle and past its dispensing end inside the spray nozzle, thereby atomizing the dispensed viscous material into a spray. When the valve is closed, the viscous material is dispensed through the dispensing nozzle and spray nozzle without being atomized and can be laid down as a bead.

Another known dispenser capable of dispensing both a bead and a spray of viscous material also comprises a cylinder for accepting a cartridge and a stock portion with a dispensing trigger connected to the stock portion. The dispenser also comprises a cap for retaining the cartridges in the body portion, with a spray nozzle securable to the cap. The body portion comprises a double wall and the cap seals around the outer of the two walls. Pressurized fluid is delivered through the gap between the double walls into a space behind the cap, from where it escapes through the spray nozzle to atomize the dispensed viscous material. The pressure of pressurized fluid between the double walls, and hence through the spray nozzle is controlled by a regulator dial on the stock portion.

The known spray and bead dispensers discussed above have several drawbacks. The location of the valve or regulator dial on a side of the body portion or on the stock portion means that it is not straightforward to adjust or switch the spray action of the dispenser while material is dispensed or without changing how the dispenser is held between dispensing actions. Further, when the flow of pressurized fluid around the dispensing nozzle is switched off to lay down a bead, there is an inherent risk of material ingress between the spray nozzle and the dispensing nozzle as the bead is laid down if the spray nozzle is not removed.

DE 9000957 U1 discloses a dispensing gun with a dispensing nozzle for dispensing viscous material and an air nozzle surrounding the dispensing nozzle to atomise dispensed material using pressurised air flowing between the two nozzles. The air nozzle can be axially displaced relative to the dispensing nozzle to open or close a passage for supplying pressurised air to the space between the two nozzles.

In a first aspect of the invention, there is provided a dispenser for dispensing viscous materials from a container through a dispensing nozzle, the dispenser comprising a fluid supply arrangement for accepting the dispensing nozzle through a nozzle receiving space and for supplying pressurized fluid to the nozzle receiving space through one or more fluid supply ports. The fluid supply arrangement comprises first and second members for accepting the dispensing nozzle therethrough. The second member is moveable relative to the first member between a first configuration in which the fluid supply ports are closed and a second configuration in which the fluid supply ports are open to supply fluid to the nozzle receiving space and is arranged to removeably accept a spray nozzle around the dispensing nozzle.

Advantageously, the arrangement of the moveable second member around the dispensing nozzle (at the very front of the dispenser) allows ergonomically convenient opening and closing of the fluid supply ports while the dispenser is held in a dispensing position. Typically, the dispenser comprises a body portion holding the container and a stock portion or handle having a trigger for triggering the application of a dispensing pressure to the container to dispense the viscous material in the container through the dispensing nozzle and to trigger the flow of pressurized fluid to the fluid to the nozzle receiving space if the fluid supply ports are open. The positioning of the fluid supply arrangement and second member for closing and opening the fluid supply ports around the dispensing nozzle means that a user can actuate the second member pressurized while holding the stock portion or handle in one hand and supporting the front of the pressurized dispenser in the region of the second member with the other hand.

In some embodiments, the second member is closer to the first member in the first configuration (with the supply ports closed) than in the second configuration (with the supply ports open). As a result, a spray nozzle secured to the second member around the dispensing nozzle moves relative to the dispensing nozzle such that a gap between the spray nozzle and the dispensing nozzle is reduced or even eliminated when the fluid supply ports are closed. This reduces or eliminates the risk of material ingress when the dispenser is used in a bead mode, without pressurized fluid flowing between the spray and dispensing nozzles.

In some embodiments, the fluid supply arrangement comprises a third member constrained for rotation relative to the first member. The second member is constrained for linear movement relative to the first member and is coupled with the third member such that rotation by a user of the third member relative to the first member causes translation of the second member relative to the first member to open or close the supply ports. This particular arrangement combines the advantages of the convenience of a rotatable control element around the dispensing nozzle at the front of the dispenser for controlling the supply of pressurized fluid to the nozzle receiving space with a simple arrangement for opening and closing the fluid supply ports based on a linear movement of the second member relative to the first member.

In some embodiments, a region of the second member is disposed in a channel between an inner and an outer wall of the first member, the outer wall in the region of the second member and the second member co-operatively defining the supply ports. Advantageously, the inner wall acts to guide pressurized fluid from the supply ports in a direction along the dispensing nozzle. In some embodiments, the fluid supply arrangement includes first and second supply port seals between the first and second members, the second member including an opening for each supply port. The opening is disposed between the first and second supply port seals in the second configuration and to one side of the first and second supply port seals in the first configuration. This provides a simple and effective arrangement in which two seals, for example O-rings, are sufficient for the provision of a potentially large number of openable and closable supply ports (subject to the space available).

In some embodiments, the first and second members are part of a cap for closing a container accepting compartment of the dispenser. Particularly, in some embodiments, the compartment defines a fluid supply path between an outer compartment wall and an inner compartment wall, and the first member has a first seal for sealing against the outer wall of the compartment and a second seal for sealing against the inner wall of the compartment. By defining a fluid path from between the seals to the supply ports, the first member and the specific arrangement of the compartment provide a simple arrangement for connecting the fluid supply arrangement in the cap to the dispenser. This can be compared to the need for a fixed conduit (hose) in one of the known dispensers described above, preventing the complete removal of the cap or the provision of pressurized fluid simply to a space under the cap as in the other known dispenser described above, which is not compatible with switchable fluid supply ports being provided in the cap.

In another aspect of the invention, there is provided a spray nozzle having a first end arranged to removably couple to the second member of a dispenser as described above to guide the pressurized fluid past a dispensing end of the dispensing nozzle when the first and second members are disposed in the second configuration.

In some embodiments, the spray nozzle comprises one or more ribs for engaging a dispensing nozzle, thereby ensuring a well-defined relationship between the spray nozzle and the dispensing nozzle and providing a passage for pressurized fluid along the dispensing nozzle. An end portion of the spray nozzle at a second end, opposed to the first end, is in some embodiments, configured to mate with an end portion at the dispensing end of the dispensing nozzle. In this way, when the end portions of the spray and dispensing nozzles mate, ingress of the dispensed material between the end portions when the dispenser is used to lay down a bead is substantially prevented or at least reduced.

In a further aspect of the invention, a dispensing nozzle is provided which is arranged for use with a spray nozzle as described above. The dispensing nozzle has an end portion at the dispensing end configured to mate with the end portion of the spray nozzle to reduce or substantially prevent ingress of dispensed material between the end portions when the end portions mate.

Further aspects of the invention extend to a kit of parts (either assembled or provided separately) including a spray nozzle and a dispensing nozzle as described above. Further, the kit of parts may include a dispenser as described above.

In a yet further aspect of the invention, there is provided a cap arranged to mate with a dispenser as described above, the cap comprising a fluid supply arrangement for accepting the dispensing nozzle through a nozzle accepting space and supplying pressurized fluid to the nozzle accepting space through one or more fluid supply ports. The cap also comprises a member secured to the cap which is moveable relative to the cap between a first configuration in which the fluid supply ports are closed and a second configuration in the fluid supply ports are open to supply fluid to the nozzle accepting space.

Advantageously, by providing a member which can be actuated to open or close the supply ports on the cap itself, a way of switching between a dispensing mode and a spray mode is provided in an ergonomic way, as a user's free hand will naturally support the dispenser in the region of the cap during dispensing.

In some embodiments, the dispenser has a body portion for accepting a container containing material to be dispensed and a pressure application interface for applying a dispensing pressure to the container, the pressure application interface being removeably secured to the body portion. The dispenser comprises a stock portion having a trigger coupled to a valve for selectively connecting the pressure application interface to a supply port for supplying pressurized fluid to the pressure application interface to dispense material from the container when the trigger is actuated and an exhaust port for venting pressurized fluid from the pressure application interface to stop dispensing of material when the trigger is released.

The pressure application interface may comprise a sealing ring for sealing against an open end of a cartridge container or may comprise a piston slidingly fitting inside the body portion to apply a dispensing pressure to a foil pack container. By routing both supply of pressurized fluid and venting to the exhaust through the stock portion, the pressure application interface is readily removable and can thus be interchanged with ease. A related aspect of the invention extends to a kit of parts including a dispenser and one of each pressure application interface just described.

BRIEF DESCRIPTION OF THE DRAWINGS

A specific embodiment of invention is now described by way of example only and with reference to the accompanying drawings in which.

DETAILED DESCRIPTION

Figure 1:
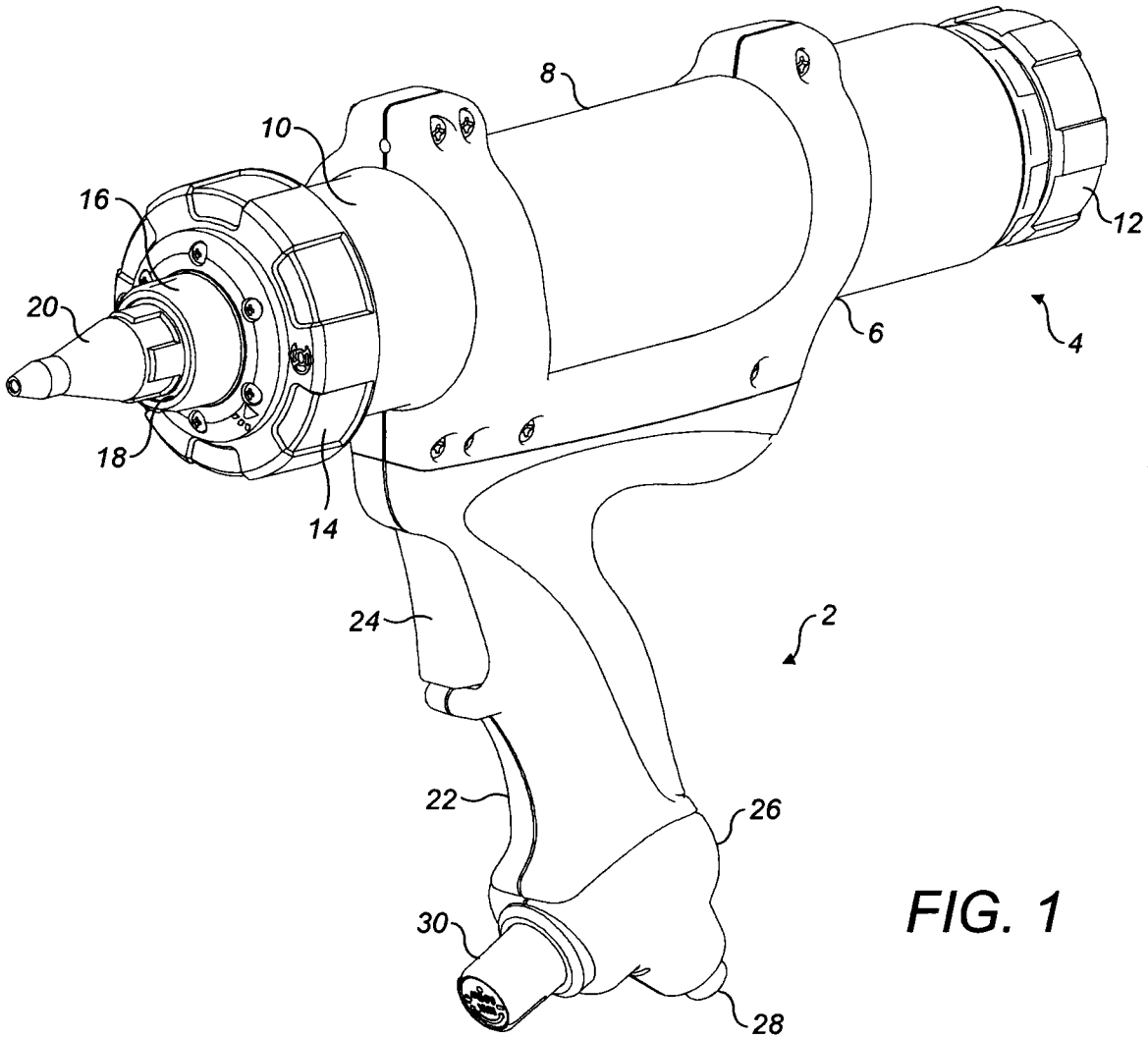
FIG. 1 shows a perspective view of a spray and bead dispenser.

With reference to FIG. 1, a dispenser comprises a stock portion 2, and a body portion 4, held by the stock portion 2 in a circumferential clamping arrangement 6. The body portion comprises a first cylindrical outer wall portion 8 and a second cylindrical outer wall portion 10 held together by the clamping arrangement 6. The body portion 4 is closed at a rear end by a threaded rear cap 12 and at the front by a threaded front cap 14. The front cap 14 comprises a rotatable member 16, which is arranged to cause linear movement of a linearly moveable member 18 relative to the cap. A spray nozzle 20 is secured to the linearly moveable member 18 by a threaded connection.

The stock portion comprises an ergonomically shaped handle 22 accommodating a trigger 24 connected to a valve for controlling flow of pressurized fluid from a regulator 26 having a quick release connection 28 for connection to a source of pressurized fluid such as compressed air. The regulator 26 comprises a dial 30 for adjusting a dispensing pressure upstream of the regulator 26.

Figure 2:
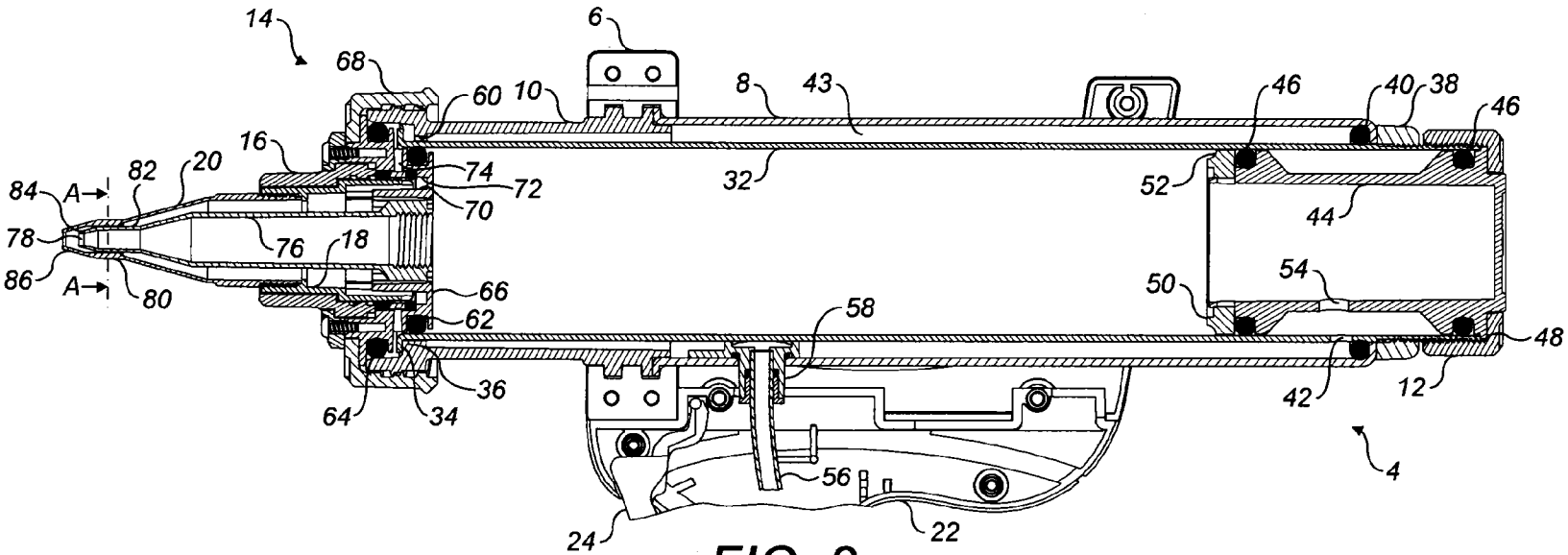
FIG. 2 shows a cross sectional view of a portion of the dispenser of FIG. 1.

With reference to FIG. 2, the body portion 4 further comprises an inner cylindrical wall 32 defining a compartment for accepting a viscous material containing container. The inner cylindrical wall 32 is held relative to the first and second outer wall portions 8, 10 by a flange 34 at the front, held against a shoulder 36 of the second outer wall portion 10 by a threaded ring 38 engaging a threaded outer surface of the inner wall 32 at the rear of the dispenser. The space between the first and second outer wall portions 8, 10 and the inner wall 32 is sealed at the rear of the dispenser by an O-ring 40. An aperture 42 at the rear of the dispenser connects a space 43 between the inner wall 32 and the outer wall portions 8, 10 to inside the inner wall 32.

A spacer member 44 seals against the inner wall 32 with O-rings 46 on either side of the aperture 42 and is held in place by the rear cap 12 holding flange 48 of the spacer 44 against a rear end of the inner wall 32. At an, opposed, front end of the spacer, a sealing ring 50 is an interference fit with a front portion of the spacer 44 and sealingly engages an adjacent one of the O-rings 46. The sealing ring 50 has an outward facing radiussed chamfer 52 for sealingly engaging an inner surface of the open rear end of a viscous material containing a cartridge. An aperture 54 in the spacer 44 provides a flow path for pressurized fluid from the aperture 42 through the sealing ring 52 into an open rear end of a cartridge held against the sealing ring 50, as described in more detail below.

A tube 56 connects the space 43, via a sealing member 58 located by the inner wall 32 and the first outer wall portion 8 to the trigger actuated valve (not shown) inside the stock portion 2. Depending on the setting of the trigger 24 and thus the valve, the space 43 is connected to either atmospheric pressure through an exhaust port of the valve connected to a silencer or to the regulator 26 by an inlet port of the valve to supply pressurized fluid from the regulator 26 to the space 43.

At the front of the dispenser, a fluid supply path from the space 43 to a fluid supply arrangement in the cap 14, described in more detail below, is defined between the inner wall 32 and the second outer wall portion 10. A ridge 60 of the second outer wall portion 10 facing the inner wall 32 limits the effective cross-section of the flow path for pressurized fluid from the space 43 to the fluid supply arrangement to limit the flow rate of fluid flow to the fluid supply arrangement for a given dispensing pressure set using the dial 30.

The cap 14 comprises a first outer O-ring 62 disposed to seal against an inner surface of the inner wall 32 and a second outer O-ring 64 disposed to seal against an inner surface of the second outer wall portion 10. The second outer O-ring 64 is disposed forward of the first outer O-ring 62 and the two O-rings thereby define a continuation of the fluid supply path from the space 43 to the cap 14. The first and second outer O-ring 62, 64 are held on a cap member 66 which is rotatably secured (that is located axially such as to allow relative rotation) to a threaded ring 68 for engaging a corresponding thread on the second outer wall portion 10 to hold the cap member 66 relative to the body portion 4 (and to hold a cartridge inside the inner wall 32 against the radiussed chamfer 52 of the sealing ring 50).

The linearly moveable member 18 is accepted in a channel between an inner wall 70 and an outer wall 72 of the cap member 66. As described in more detail below, movement of the linearly moveable member 18 relative to the cap member 66 forms or breaks a seal formed between the linearly moveable member 18 and the outer wall 72 of the cap member 66 so that pressurized fluid can flow from the flow path between the inner wall 32 and the second outer wall portion 10 through a conduit 74 in the cap member 66 along the inner wall 70 and into a space inside the linearly moveable member 18, thereby providing an open and closeable fluid supply port for supplying fluid to a space around a dispensing nozzle 76 disposed through the cap member 66 and the linearly moveable member 18. (In use the dispensing nozzle is connected to a viscous material containing container, not shown in FIG. 2).

The linearly moveable member 18 and cap member 66 are arranged such that they are spaced further apart (the linearly moveable member 18 being less inserted into the channel between the inner and outer walls 70,72) when the fluid supply ports are open as compared to when they are closed. FIG. 2 depicts the linearly moveable member 18 and cap member 66 in a configuration where the supply ports are open. In this configuration, the spray nozzle 20, secured to the linearly moveable member 18, around the dispensing nozzle 76, extends forward of a dispensing end 78 of the dispensing nozzle 76 to guide pressurized fluid past the dispensing end 78 so as to atomize dispensed material to create a spray of the material.

Figure 3:
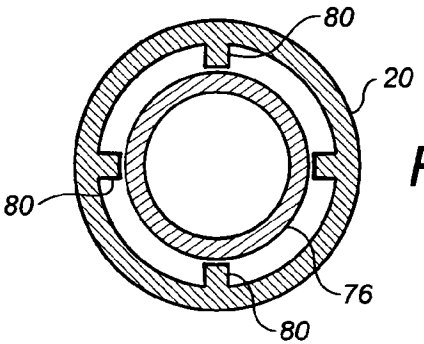
FIG. 3 shows a cross sectional view along the line A-A through nozzles of the dispenser, as indicated in FIG. 2.

As is illustrated in FIG. 3, the spray nozzle 20 has a portion adjacent its forward end which comprises ribs 80 for locating a corresponding linear portion 82 of the dispensing nozzle to hold the dispensing nozzle in a well-defined relationship relative to the spray nozzle 20 while at the same time providing a path for a pressurized fluid to flow along the dispensing nozzle 76 past its dispensing end 78. As will be described in further detail below, to close the fluid supply ports, the linearly moveable member 18 is inserted further into the channel defined between the inner and outer wall 70, 72 of the cap member 66 by rotation of the rotatable member 16. At the same time, the spray nozzle 20, which is secured to the linearly moveable member 18, travels rearward along the dispensing nozzle 76, with the ribs 80 sliding along the linear portion 82. The respective end portions 84 and 86 of the dispensing and spray nozzles are configured to be of complementary shape, such that they mate when the linearly moveable member 18 is fully inserted into the cap member 66 to close the fluid supply ports. Thus, the interior of the spray nozzle 20 is substantially sealed from material being dispensed from the dispensing end 78 of the dispensing nozzle 76 to reduce or substantially prevent material ingress to the spray nozzle 20 when the fluid supply ports are closed to dispense material as a bead, rather than as a spray.

Figure 4:
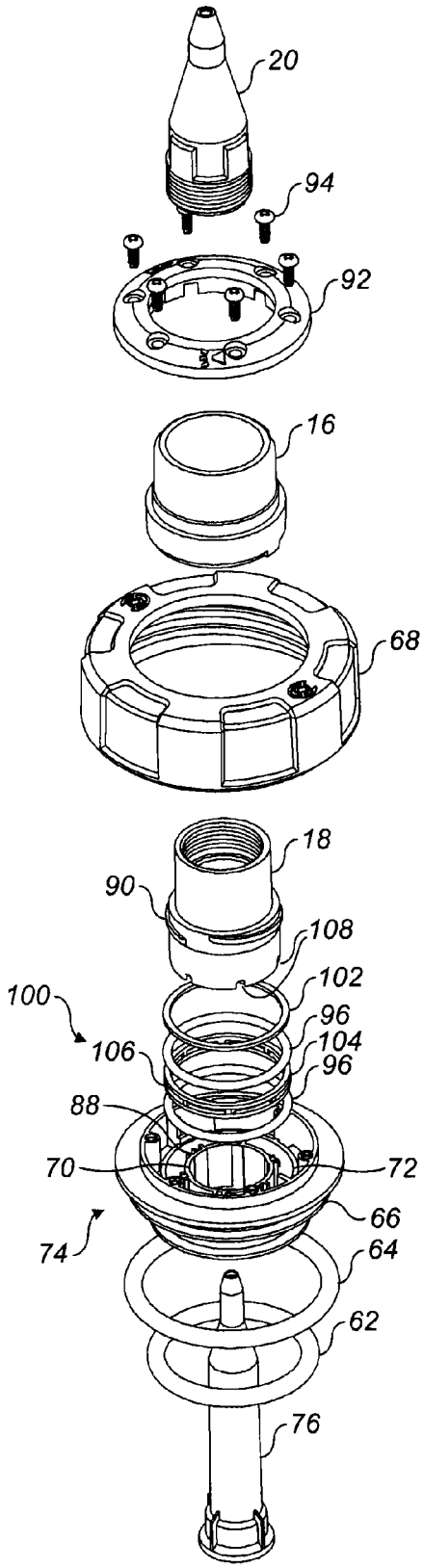
FIG. 4 shows an exploded view of a cap of the dispenser of FIG. 1, together with a dispensing nozzle and a spray nozzle.
Figure 5:
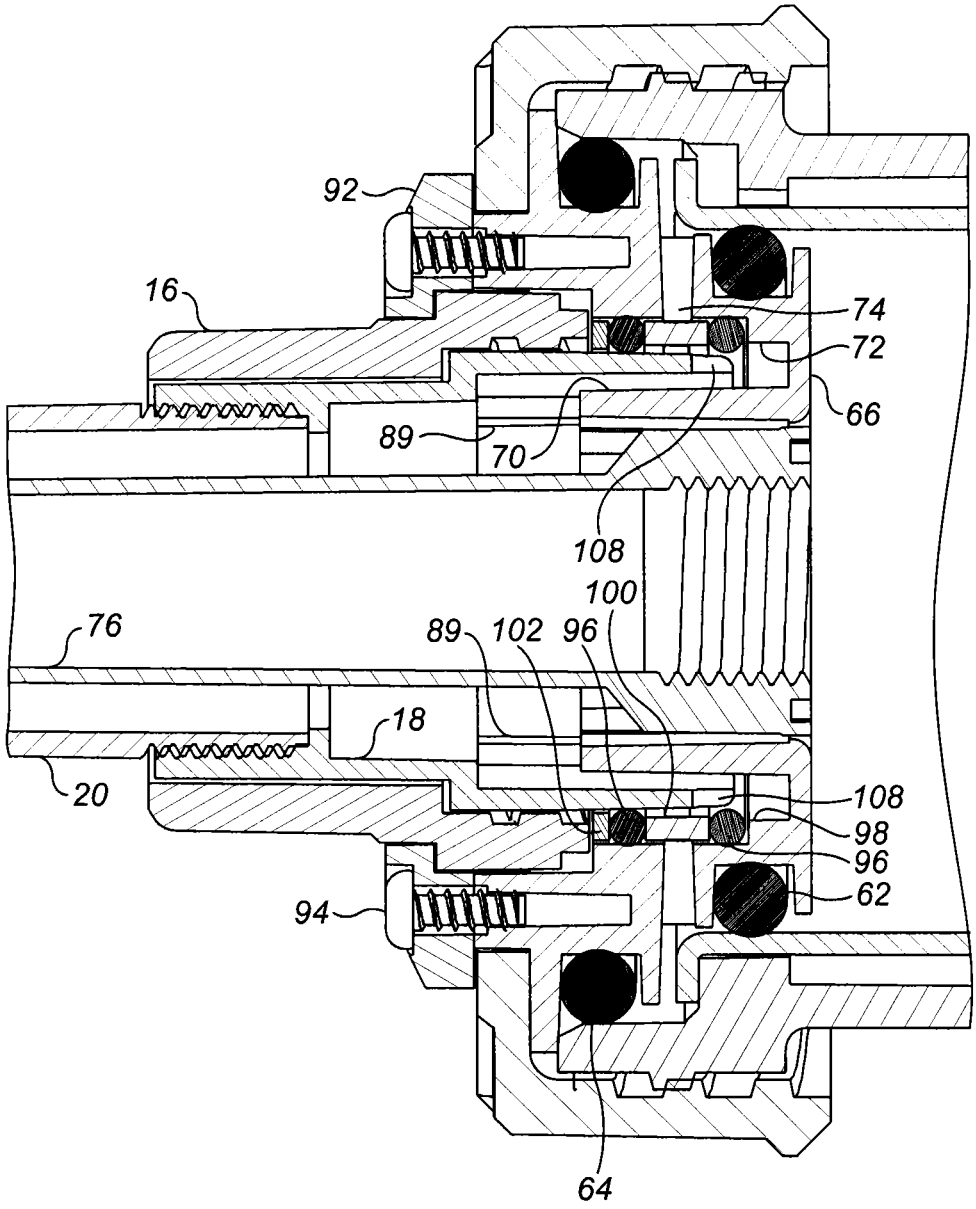
FIG. 5 shows an enlarged view of a portion of the view shown in FIG. 2.

With reference to FIGS. 4 and 5, the arrangement for opening and closing the supply ports is now described in detail. As briefly mentioned above, the linearly moveable member 18 slots into a channel between inner and outer walls 70, 72 of the cap member 66. The inner wall 70 defines ridges 88 which mesh with corresponding ridges 89 (not visible in FIG. 4) on an interior surface of the linearly moveable member 18 to constrain the linearly moveable member 18 for linear movement relative to the cap member 66. The linear moveable member 18 is linked to the rotatable member 16 by a two-start high-pitch thread 90. The rotatable member 16 is rotatably secured to the cap member 66, together with the threaded ring 68, by a retaining ring 92 secured to the cap member 66 by screws 94. In this way, rotation of the rotatable member 16 results in a linear movement in and out of the channel between the walls 70, 72 of the linear moveable member 18.

Between an outer aspect of the linear moveable member 18 and an inner aspect of the outer wall 72, a respective O-ring 96 is disposed on either side of the conduit 74, maintained in place by a shoulder 98 of the outer wall 72, a spacer 100 and a washer 102. On one side of the conduit 74, the other one of the O-rings 96 is held in place between the shoulder 98 and the spacer 100 and on the other side of the conduit 74, one of the O-rings 96 is held in place between the spacer 100 and the washer 102. The washer 102, in turn, is held in its position by the rotatable member 16. The spacer 100 comprises two rings 104 spaced by webs 106 to allow pressurized fluid to pass from the conduit 74 between the rings 104.

The linearly movable member 18, at an end opposed to the end accepting the spray nozzle 20, defines openings or slots 108. When the linearly moveable member 18 is fully inserted between the walls 70, 72 of the cap member 66, both of the O-rings 96 seal against an outer aspect of the linearly moveable member 18, thus isolating the conduit 74 from the space within the cap member 66 and the linearly moveable member 18 in which the dispensing nozzle 76 is accepted. In the configuration shown in FIGS. 2 and 5, the linearly moveable member 18 is partially retracted out of the channel between the walls 70, 72 such that the openings 108 are now extending forward of one of the O-rings 96 and the seal is broken. The conduit 74 is thus in fluidic communication with the space accepting the dispensing nozzle 76 via the openings 108. The conduit 74 together with the O-rings 96 and the openings 108 hence provides fluid supply ports for supplying pneumatic fluid to the space accepting the dispensing nozzle 76 which can be opened and closed by linear movement of the linearly moveable member 18 when the rotatable member 16 is rotated.

In operation, the cap 14 is removed from the body portion 4 and a cartridge is inserted into the space defined by the inner wall 32 to abut the radiussed chamfer 52 of the sealing ring 50 with its open end. The cap 14 is then secured to the body portion 4, with the dispensing nozzle 76 disposed through the cap member 66 and the linearly moveable member 18 and the cartridge held in place against the sealing ring 52 by the cap member 66. On actuation of the trigger 24, pressurized fluid from a source of pressurized fluid connected to the quick release connector 28 is supplied to both the spacer 44 (and hence the inside of the cartridge to drive the cartridge's piston) and to the cap 14, as described above, with a pressure regulated by the regulator 26. In order to dispense a bead of material, the linearly moveable member 18 is fully inserted between the wall 70 and 72. For dispensing a spray, the linearly moveable member 18 is retracted sufficiently to allow pressurized fluid from the conduit 74 to flow through the openings 108. The spray action can be controlled between fully closed (no spray, bead is dispensed) and fully open (maximally atomized spray) by rotation of the rotatable member 16 with the hand not holding the handle 22, either between dispensing operations or while material is dispensed.

The above description of a specific embodiment has been made in terms of an arrangement for dispensing from a container in the form of a cartridge. However, due to the readily removable nature of the spacer 44 by unscrewing the rear cap 12, the dispenser described above can be readily adapted for dispensing viscous material from foil containers, known in the art as "sausage packs." This can be done by unscrewing the cap 12, removing the spacer 44, and in its place inserting a piston which sealingly fits the inner wall 32 and an alternative spacer behind it. The alternative spacer serves to seal the rear end of the dispenser in the same way as a rear portion of the spacer 44 and ensures that pressurized fluid from the aperture 42 is applied behind the piston. After the spacer 44 has been replaced with the piston and alternative spacer, the alternative spacer is held in place in the same way as the spacer 44 by re-fastening the rear cap 12. The foil container is used with an alternative nozzle which has a flange for engaging the cap member 66. Pressurized fluid from the aperture 42 now drives the piston against a foil container contained inside the wall 32 to dispense viscous material in the same way as for a cartridge container.

The above description has been made in terms of a specific embodiment of the invention and it will be understood that many modifications, alterations and juxtapositions of the features described above are possible without departing from the invention and are intended to be covered by the claims below. Some such modifications are discussed in what follows.

While, in the embodiment described above, the fluid conduit from the regulator 26 to inside of the inner wall 32 and to the cap 14 includes a fluid path defined by an outer wall or sleeve disposed around the inner wall 32, many other arrangements for providing a fluid flow path from the regulator to the cartridge containing space and/or the cap 14 can be provided, for example using respective externally routed air hoses or a combination of externally routed air hoses and air conduits routed inside an extension of the stock portion 2.

In terms of the ready interchangeability of the spacer 44 against other pressure delivering interfaces, for example, spacers of different lengths to accommodate different cartridges or a combination of a piston and spacer for use with foil packs, as described above, it is preferable that the rear cap 12 is readily removable and, therefore, that any air connections are made on the body portion and not on the rear cap 12. In the same light, it can be preferable that both the inlet port and the exhaust port, respectively supplying pressurized fluid and venting pressurized fluid to the space 43, be provided within the stock portion 22 to keep any pneumatic components away from the rear end of the body portion port so as not to interfere with the ready interchangeability of the spacer 44. However, alternative locations for these components are equally possible.

It will be understood that alternative arrangements for opening and closing the fluid supply ports can be used, for example using a linearly moveable member directly actuated by the user (rather than via a rotatable member), a rotatable member on a thread, converting rotation of the member to linear movement relative to the cap by virtue of the thread or a purely rotational member for opening and closing the fluid supply ports, together with a corresponding rearrangement of the corresponding seals from a transverse orientation to a longitudinal orientation.

While the spray nozzle 20 has been described as removeably connected to the linearly moveable member 18, it will be understood that the spray nozzle may equally form part of the linearly moveably member 18 or other member for opening and closing the supply ports. Finally, while the fastening arrangements for, for example, fastening the spray nozzle 20 to the cap 14 or fastening the cap 14 to the body portion 4 (or the rear cap 12), as the fastening arrangements may equally be used, such as bayonet fastening arrangements or any other kind of suitable fastening arrangement. Indeed, while the embodiment described above has a fastener at each end, other embodiments have a body portion which can only be opened at one end, either front or rear. Thus, the body portion can be loaded with a container from the front with an integrally closed rear end or from the rear with an integrally formed front portion arranged to accept the dispensing nozzle through it and to provide the functionality of the cap described above in terms of supplying pressurized fluid for spray formation.

The above described specific embodiment is manufactured from a combination of metal (such as aluminium) for the inner wall 32 and outer wall portion 8, 10 and plastic materials (such as acetal or nylon with glass content as necessary) for the remaining structural components. The nozzles are manufactured from plastics such as High Density Polyethylene. It will be understood that any suitable combination of metal and plastic materials, including construction with all structural parts made from plastic materials can be used in alternative embodiments. Numerous materials are suitable for use in the sealing parts such as O-rings, for pressure connecting hoses and tubes and other pneumatic components such as valves and connectors, as is well known to the person skilled in the art.

What is claimed is:

1. A dispenser for dispensing a viscous material from a container through a dispensing nozzle, the dispenser comprising a fluid supply arrangement for accepting the dispensing nozzle through a nozzle receiving space and for supplying pressurized fluid to the nozzle receiving space through one or more fluid supply ports, wherein the fluid supply arrangement comprises first, second and third members for accepting the dispensing nozzle therethrough, wherein the third member is constrained for rotation relative to the first member, wherein the second and third members are coupled such that rotation of the third member relative to the first member and the second member causes translation of the second member relative to the first member between a first configuration in which the one or more fluid supply ports are closed and a second configuration in which the one or more fluid supply ports are open to supply fluid to the nozzle receiving space, and wherein the second member is arranged to removably accept a spray nozzle around the dispensing nozzle.

2. The dispenser of claim 1 wherein the second member is closer to the first member in the first configuration than in the second configuration.

3. The dispenser of claim 1 wherein a region of the second member is disposed in a channel between an inner wall and an outer wall of the first member, the outer wall and the region of the second member cooperatively defining the one or more supply ports.

4. The dispenser of claim 1 wherein the fluid supply arrangement includes first and second supply port seals between the first and second members, the second member including an opening, disposed between the first and second supply port seals in the second configuration and to one side of the first and second supply port seals in the first configuration, for each supply port.

5. The dispenser of claim 1 wherein the first and second members are part of a cap for closing a container accepting compartment of the dispenser.

6. The dispenser of claim 5 wherein the compartment defines a fluid supply path between an outer compartment wall and an inner compartment wall, and the first member has a first seal for sealing against the outer wall of the compartment and a second seal for sealing against the inner wall of the compartment and defines a fluid path from between the seals to the one or more supply ports.

7. The dispenser of claim 1, further comprising a spray nozzle having a first end arranged to removeably couple to the second member of the dispenser to guide the pressurized fluid past a dispensing end of the dispensing nozzle when the first and second members are disposed in the second configuration.

8. The dispenser of claim 7 wherein the spray nozzle comprises one or more ribs for engaging the dispensing nozzle to provide a passage for pressurized fluid along the dispensing nozzle.

9. The dispenser of claim 7 wherein an end portion of the spray nozzle at a second end, opposed to the first end, is configured to mate with an end portion at the dispensing end of the dispensing nozzle to reduce ingress of dispensed material between the end portions when the end portions mate.

10. The dispenser of claim 7, wherein the dispenser, the spray nozzle and the dispensing nozzle are included in a kit of parts.

11. The dispenser of claim 1, further comprising a front cap arranged to mate with the dispenser, the front cap including the fluid supply arrangement and the second member being secured to the front cap.

* * * * *